US010696922B2

(12) United States Patent
Bauer et al.

(10) Patent No.: US 10,696,922 B2
(45) Date of Patent: Jun. 30, 2020

(54) PROCESS FOR PREPARING FATTY ACIDS BY ESTER HYDROLYSIS

(71) Applicant: L'Air Liquide, Societe Anonyme pour l'Etude et l'Exploitation des Procedes Georges Claude, Paris (FR)

(72) Inventors: Ingo Bauer, Bad Vilbel (DE); Armin Brandner, Egelsbach (DE); Gunter Brauner, Bad Wimpfen (DE); Matthias Kasper, Rodermark (DE); Peter Potschacher, Frankfurt am Main (DE)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 0 days.

(21) Appl. No.: 16/316,248

(22) PCT Filed: Jun. 27, 2017

(86) PCT No.: PCT/EP2017/025181

§ 371 (c)(1),
(2) Date: Jan. 8, 2019

(87) PCT Pub. No.: WO2018/007022

PCT Pub. Date: Jan. 11, 2018

(65) Prior Publication Data

US 2019/0211282 A1 Jul. 11, 2019

(30) Foreign Application Priority Data

Aug. 7, 2016 (EP) ..... 16400026

(51) Int. Cl.

| | |
|---|---|
| ***C11C 1/04*** | (2006.01) |
| ***C11C 1/08*** | (2006.01) |
| ***C11C 3/00*** | (2006.01) |

(52) U.S. Cl.
CPC ..... *C11C 1/04* (2013.01); *C11C 1/08* (2013.01); *C11C 3/003* (2013.01)

(58) Field of Classification Search
CPC ..... C11C 1/04; C11C 1/08; C11C 3/003
(Continued)

(56) References Cited

U.S. PATENT DOCUMENTS 4,185,027 A 1/1980 Logan

FOREIGN PATENT DOCUMENTS

DE 69 321 607 3/1999
GB 594141 11/1947
(Continued)

OTHER PUBLICATIONS

Wang et al., Computers and Chemical Engineering, vol. 58, pp. 144-155, 2013.*

(Continued)

*Primary Examiner* — Deborah D Carr
(74) *Attorney, Agent, or Firm* — Justin K. Murray; Elwood L. Haynes

(57) ABSTRACT

A process and a plant are specified, with which free fatty acids can be obtained in a simple manner by hydrolysis of fatty acid alkyl esters, especially fatty acid methyl esters (FAME), or alternatively of fatty acid triglycerides present in oils and fats of vegetable and animal origin. According to the invention, a portion of the free fatty acids already produced is recycled back into the reaction mixture, which results in self-acceleration of the hydrolysis reaction.

18 Claims, 2 Drawing Sheets

(58) Field of Classification Search
USPC ..... 554/163
See application file for complete search history.

(56) References Cited

FOREIGN PATENT DOCUMENTS

| | | | |
|---|---|---|---|
| GB | 594141 A | * | 11/1947 |
| WO | WO 97/07187 | | 2/1997 |

OTHER PUBLICATIONS

International Search Report and Written Opinion for PCT/EP2017/025181, dated Sep. 13, 2017.
Wang, et al., "Product sampling during transient continuous countercurrent hydrolysis of canola oil and development of a kinetic model," Computers & Chemical Engineering, vol. 58, 2013, pp. 144-155.
Russell, et al., "Hydrolysis of Vegetable Oils in Sub- and Supercritical Water," Industrial & Engineering Chemistry Research, vol. 36, No. 3, Mar. 1, 1997, pp. 932-935.
Da Silva, et al., "Biodiesel production through non-catalytic supercritical transesterification: current state and perspectives," Brazilian Journal of Chemical Engineering, vol. 31, No. 2, Jun. 1, 2014, pp. 271-285.
Saka, et al., "Kinetics in Hydrolysis of Oils/Fats and Subsequent Methyl Esterification in Two-Step Supercritical Methanol Method for Biodiesel Production," Jan. 1, 2006, Retrieved from Internet: URL:http://www.jgsee.kmutt.ac.th/see1/cd/file/C-040.pdf (retrieved on Jan. 10, 2017).

* cited by examiner

PROCESS FOR PREPARING FATTY ACIDS BY ESTER HYDROLYSIS

CROSS REFERENCE TO RELATED APPLICATIONS

This application is a § 371 of International PCT Application PCT/EP2017/025181, filed Jun. 27, 2017, which claims the benefit of EP16400026.7, filed Jul. 8, 2016, both of which are herein incorporated by reference in their entireties.

FIELD OF THE INVENTION

The invention relates to a process for preparing fatty acids by hydrolysis of fatty acid alkyl esters, especially fatty acid methyl esters (FAME), or alternatively of fatty acid triglycerides present in oils and fats of vegetable and animal origin, at high temperature and high pressure in the liquid phase without the addition of external substances extraneous to the process as homogeneous or heterogeneous catalysts, and to the workup of the hydrolysis product obtained to give free fatty acids. The invention further relates to a plant for performing the process.

BACKGROUND OF THE INVENTION

The reverse reaction of esterification is called ester cleavage or ester hydrolysis. In this hydrolysis, one mole of water is consumed per mole of ester bond, giving rise to one mole each of free acid and alcohol. Being the reverse reaction of esterification, hydrolysis is likewise an equilibrium reaction.

In oleo-technology, the hydrolysis of triglycerides, i.e. the hydrolysis of oils and fats of vegetable and animal origin, is a procedure well known to those skilled in the art for preparing free fatty acids. For instance, triglycerides are hydrolysed with addition and consumption of water at temperatures of 200° C. or higher and at a corresponding water vapour pressure in the liquid phase to glycerol and free fatty acids (FFA). An example of an industrial embodiment of this process is the Lurgi splitting tower process. This type of reaction regime for ester hydrolysis is established in industry and proceeds with high efficiency, since the glycerol that forms separates out of the reaction mixture as a separate phase during the reaction and hence promotes a shift in the reaction equilibrium in the direction of the FFA target reaction product. Further details of the known procedures for hydrolysis of triglycerides can be found, for example, in Ullmann's Encyclopedia of Industrial Chemistry, Sixth Edition, 1998 Electronic Release, under "Fatty Acids", chapter 3.2 "Fat Splitting".

For preparation of fatty acids by hydrolysis of fatty acid alkyl esters, especially of fatty acid methyl esters (FAME), the literature describes processes which counteract establishment of equilibrium by evaporation of methanol formed out of the reaction mixture. These processes work at low pressure, for example ambient pressure, within a temperature range of, for example, 70 to 150° C. As a result of these low reaction temperatures, it is necessary to catalytically accelerate the reaction in order to achieve the desired high conversions based on industry standard reaction times and residence times.

For example, patent publication DE 69321607 T2 describes splitting of a FAME mixture of methyl caprylate and methyl capronate, conducted at ambient pressure in the range from 70 to 110° C., wherein an acidic, homogeneously dissolved catalyst comprising alkylbenzenesulphonic acids is used. As is the case with many homogeneously catalysed processes, here too, there is the drawback of separation and workup for reuse of the catalyst from the reaction mixture. A distillative workup of the reaction mixture under reduced pressure is likewise described here, wherein, in a first stage, methanol, water and unconverted fatty acid methyl ester are removed. In a second stage, the FFA product is then separated from the catalyst and the latter is recycled into the reaction system.

US patent specification U.S. Pat. No. 4,185,027 describes an acid-catalysed process using sulphuric acid, p-toluenesulphonic acid or acidic ion exchanger within a similar temperature range to that in DE 69321607 T2, wherein propionic acid is additionally added as short-chain carboxylic acid. This reacts with release of the fatty acid to give methyl propionate as an intermediate. In this case too, the short-chain carboxylic acid added, as well as the catalyst, has to be separated from the reaction mixture in a costly and inconvenient manner. In the case of use of ion exchangers as catalyst, the removal of catalyst is simplified, but the conversions described are much lower compared to the conversions achieved in the case of homogeneous catalysis (sulphuric acid, p-toluenesulphonic acid), or high concentrations of, for example, 12 to 27 g of ion exchanger are required per 100 g of FAME in order to achieve high conversions within an appropriate time. Moreover, in this variant too, the propionic acid added finally has to be removed from the reaction mixture.

SUMMARY OF THE INVENTION

The problem addressed by certain embodiments of the present invention is therefore that of specifying a very simple process for preparing fatty acids by hydrolysis of fatty acid alkyl esters at high temperature and high pressure in the liquid phase without addition of external substances extraneous to the process as homogeneous or heterogeneous catalysts, in which the abovementioned disadvantages occur only to a minor degree, if at all.

This problem is solved by a process and a plant having the features as disclosed herein.

Process According to an Embodiment of the Invention:

Process for preparing fatty acids by hydrolysis of fatty acid alkyl esters, especially fatty acid methyl esters (FAME), or of fatty acid triglycerides, can include the following steps:

a) providing the fatty acid alkyl esters or the fatty acid triglycerides,
b) reacting the fatty acid alkyl esters or the fatty acid triglycerides with water under hydrolysis conditions at temperatures of at least 200° C., where the pressure is chosen such that the water is in the liquid phase and where no external substance extraneous to the process is added as homogeneous or heterogeneous catalyst,
c) discharging a hydrolysis product comprising free fatty acids (FFA), water, unconverted fatty acid alkyl esters and the corresponding alkanol, especially methanol, or unconverted fatty acid triglycerides and glycerol,
d) feeding the hydrolysis product to a phase separation apparatus and separating the hydrolysis product under phase separation conditions into a light phase comprising free fatty acids and unconverted fatty acid alkyl esters or unconverted fatty acid triglycerides and a heavy phase comprising water and methanol or glycerol,
e) feeding the light phase into a first separation apparatus that works by a thermal separation process and separating the light phase into a first separation product enriched in free fatty acids and a second separation product enriched in unconverted fatty acid alkyl esters or in unconverted fatty acid triglycerides, the separation being conducted in such a way that the second separation product further comprises a proportion of free fatty acids, f) discharging the first separation product as FFA product, and g) recycling at least a portion of the second separation product to reaction step b).

Plant According to an Embodiment the Invention:

Plant for preparation of fatty acids by hydrolysis of fatty acid alkyl esters, especially fatty acid methyl esters (FAME), or of fatty acid triglycerides, comprising the following plant components:

a) means of providing the fatty acid alkyl esters or the fatty acid triglycerides, b) at least one hydrolysis reactor for reacting the fatty acid alkyl esters or the fatty acid triglycerides with water under hydrolysis conditions at temperatures of at least 200° C., suitable for establishing a pressure at which the water is in the liquid phase at the reaction temperature, c) means of discharging a hydrolysis product comprising free fatty acids (FFA), water, unconverted fatty acid alkyl esters and the corresponding alkanol, especially methanol, or unconverted fatty acid triglycerides and glycerol, d) a phase separation apparatus suitable for separating the hydrolysis product under phase separation conditions into a light phase comprising free fatty acids and unconverted fatty acid alkyl esters or unconverted fatty acid triglycerides and a heavy phase comprising water and methanol or glycerol, means of feeding the hydrolysis product to the phase separation apparatus, means of discharging the light phase, means of discharging the heavy phase, e) a first separation apparatus which works by a thermal separation process, suitable for separating the light phase into a first separation product enriched in free fatty acids and a second separation product enriched in unconverted fatty acid alkyl esters or in unconverted fatty acid triglycerides, the second separation product further comprising a proportion of free fatty acids, means of feeding the light phase into the first separation apparatus, means of discharging a first separation product from the first separation apparatus, means of discharging a second separation product from the first separation apparatus, f) means of discharging the first separation product as FFA product, g) means of recycling at least a portion of the second separation product to the at least one hydrolysis reactor.

"Under hydrolysis conditions" is understood to mean those reaction conditions that bring about at least a partial conversion, preferably a conversion of industrial or economic relevance, of the fatty acid alkyl esters or the fatty acid triglycerides to free fatty acids. The person skilled in the art will select hydrolysis conditions known from the prior art and, if necessary, modify them on the basis of routine tests in order to match them to other boundary conditions of the process procedure.

External substances extraneous to the process are understood to mean those substances that do not take part in the hydrolysis reaction or in the converse esterification reaction as co-reactants, and accordingly do not appear in the corresponding reaction equations.

The terms "light phase" and "heavy phase" relate to the respective density (the "specific weight") of the two liquid phases obtained from the hydrolysis product under phase separation conditions.

"Phase separation conditions" are understood to mean all physicochemical parameters which enable, promote or accelerate the formation of the two liquid phases obtained from the hydrolysis product. Important parameters in this connection are the temperature and the strength of the field of gravity (e.g. the Earth's gravity or a higher gravitational effect, for example in the case of centrifugation).

"Thermal separation processes" are understood to mean all separation processes based on the establishment of a thermodynamic phase equilibrium. More particularly, in the context of the present invention, these are distillation or rectification, which make use of the establishment of the evaporation equilibrium of the substances involved.

If it is a requirement that the separation be conducted in such a way that the second separation product further comprises a proportion of free fatty acids, the person skilled in the art will be able to configure the underlying thermal separation process in such a way that this objective is achieved. Thus, in the employment of the distillation, he will correspondingly choose the temperature profiles in the distillation apparatus, the reflux ratio and the flow rates of the top product and the bottom product.

Means of introducing, discharging, feeding, recycling, etc. are understood to mean all means that serve this purpose, i.e. especially but not exclusively pipelines, pumps, compressors and intermediate vessels.

Especially in the case of a continuous reaction regime, all plant components are in fluid connection with one another. Fluid connection between two plant components is understood to mean any kind of connection that enables flow of a fluid, for example the reaction mixture, the hydrolysis product or the individual separation products, from one to the other of the two plant components, regardless of any intervening regions or components.

The hydrolysis reactor selected by the person skilled in the art will be a suitable reaction apparatus. More particularly, these are reaction apparatuses having high mixing or back-mixing. Therefore, useful reactors in the case of a batchwise reaction regime are especially stirred reactors, and useful continuous stirred reactors are, for example, continuous stirred tank reactors, stirred tank cascades or tower reactors with segmented mixing (hydrolysis tower). These should be designed such that they are suitable for establishing the pressure required, which is effected inter alia via the selection of appropriate wall thicknesses and the provision of suitable pressure-retaining elements.

The invention is based on the finding that the hydrolysis of fatty acid alkyl esters and fatty acid triglycerides can be accelerated in an autocatalytic manner. As soon as the first, slight conversion to the reaction products has occurred (initiation phase), the free fatty acid formed, because of its acidity, acts as catalyst for the hydrolysis reaction, as a result of which the ester hydrolysis is subsequently accelerated. Viewed against time, this gives rise to a typical S-shaped profile of the conversion curve.

As a result of the performance of the separation of the light phase of the hydrolysis product in such a way that a certain proportion of free fatty acid is still present in the fraction that also comprises the unconverted fatty acid alkyl esters and fatty acid triglycerides, and the subsequent recycling of at least a portion of this fraction into the hydrolysis reaction, a proportion of free fatty acid gets into the hydrolysis reactor and can have an accelerating effect on the reaction rate of the hydrolysis therein.

It should be noted that the equilibrium position of the hydrolysis reaction is shifted toward the reactants by the supply of free fatty acid as reaction product. With regard to the small amounts of free fatty acid required for the catalytic action, however, this effect can only be regarded as a minor effect. Overall, economic advantages result from the higher reaction rate. These are manifested especially in the case of a continuous reaction regime, for example in a continuous stirred tank reactor, a stirred tank cascade or another continuous reaction apparatus with high backmixing: in the steady state, the fresh, i.e. non-prereacted, reactants fed in already encounter a non-zero concentration of free fatty acid as catalyst in the hydrolysis reactor. As a result, the initiation phase is effectively skipped and the conversion curve against time immediately rises rapidly. To achieve a defined final conversion, therefore, there is a reduction in the reactor size required.

In the case of a batchwise reaction regime, the invention can be employed, for example, such that a portion of the free fatty acids obtained from a prior reaction mixture is retained and then added as catalyst to a subsequent reaction batch.

In a preferred configuration of the process of the invention, the separation of the light phase (step e)) and/or the recycling of at least a portion of the second separation product to reaction step b) (step g)) are effected in such a way that, during reaction step b), the proportion of free fatty acids, based on the proportion of fatty acid alkyl ester or fatty acid triglycerides, is >0% to 10% by weight, preferably 0.1% to 8% by weight, most preferably 0.5% to 5% by weight. It has been found that a favourable compromise is obtained within these free fatty acid concentration ranges between the catalytic acceleration of the reaction on the one hand and the adverse effect on the equilibrium position on the other hand.

In a further preferred configuration of the process according to the invention, reaction step b) is conducted at a temperature of at least 220° C., preferably at least 240° C., most preferably at least 260° C. These reaction temperatures are favourable compromises between high reaction rates, the onset of side reactions as a result of thermal breakdown of the substances involved, and the technical complexity involved in retaining the pressure, in order to keep water in the liquid phase.

In a preferred configuration of a process for preparing fatty acids by hydrolysis of fatty acid methyl esters (FAME), the methanol-comprising heavy phase obtained in step d) is fed to a second separation apparatus that works by a thermal separation process and separated into a methanol-enriched third separation product and a water-enriched fourth separation product, the third separation product being discharged from the process as methanol product and the fourth separation product being at least partly recycled to reaction step b). In this way, the use of fresh water as reactant is reduced and—optionally after further workup—a marketable methanol product is obtained as by-product. Alternatively or additionally, methanol can be directly discharged from the reaction apparatus as top product. As a result, the reaction equilibrium is shifted in the direction of the hydrolysis products and hence the hydrolysis reaction is promoted.

In a further aspect of the invention, in a process for preparing fatty acids by hydrolysis of fatty acid methyl esters (FAME), the hydrolysis product obtained in reaction step b) is first fed to the second separation apparatus in which a methanol-enriched top product is selectively separated from the hydrolysis product and discharged from the process as methanol product. In this way too—optionally after further workup—a marketable methanol product is obtained as by-product.

Alternatively or additionally, methanol can be directly discharged from the reaction apparatus as top product. As a result, the reaction equilibrium is shifted in the direction of the hydrolysis products and hence the hydrolysis reaction is promoted. In addition, the amount or flow rate of the hydrolysis product is reduced, such that the downstream phase separation apparatus can be made smaller. If the hydrolysis product that has been freed of a portion of the methanol is to be cooled prior to introduction into the phase separation apparatus, in order to promote phase separation, the reduction in volume additionally results in a reduction in the amount of cooling energy required.

It is particularly preferable here that the second separation apparatus is configured as a flash stage which is preferably configured and operated in an adiabatic manner. As a result, there is already preliminary cooling of the hydrolysis product that has been freed of a portion of the methanol prior to introduction into the phase separation apparatus, such that the amount of cooling energy required is reduced. In particularly favourable cases in which the adiabatic expansion already brings about sufficient cooling action, it is possible as a result for a cooling apparatus upstream of the phase separation apparatus to be dispensed with completely. However, it is generally preferable that a cooling apparatus upstream of the phase separation apparatus is also present, since this gives rise to greater degrees of freedom with regard to the adjustment of the temperature in the phase separation apparatus.

In a development of the two preferred embodiments discussed above, the methanol-depleted hydrolysis product is fed to the phase separation apparatus and separated therein under phase separation conditions into a light phase comprising free fatty acids and unconverted fatty acid alkyl esters and a heavy phase comprising water and methanol, the heavy phase being at least partly recycled to reaction step b) and the light phase being fed to the first separation apparatus. The prior removal of a portion of the methanol from the hydrolysis product improves and facilitates the phase separation in the phase separation apparatus, since methanol acts as solubilizer between the light organic/nonpolar phase and the heavy aqueous/polar phase and hence prevents phase separation.

Preferably, the phase separation conditions comprise the cooling of the hydrolysis product or of the methanol-depleted hydrolysis product to a temperature of ≤220° C., preferably ≤200° C., most preferably ≤180° C. This further improves and facilitates phase separation in the phase separation apparatus. The improvement and facilitation of phase separation is understood to mean the formation of a very sharp, well-defined phase boundary within a minimum time.

In relation to the aforementioned aspect of the invention, the cooling is brought about by means of a cooling apparatus upstream of the phase separation apparatus and/or by virtue of the separation of the methanol-enriched top product from the hydrolysis product being conducted adiabatically. The adiabatic cooling already results in preliminary cooling of the hydrolysis product that has been freed of a portion of the methanol before it is introduced into the phase separation apparatus, such that the amount of cooling energy required is reduced. In particularly favourable cases in which the adiabatic expansion already brings about sufficient cooling action, it is possible as a result for a cooling apparatus upstream of the phase separation apparatus to be dispensed with completely. In other cases, residual cooling is effected by means of a cooling apparatus upstream of the phase separation apparatus, but one which can be made smaller because of the prior adiabatic cooling.

In a preferred configuration of the process of the invention, in the reaction of the fatty acid methyl ester with water in step b), the ratio of water to fatty acid methyl ester is at least 2 mol/mol, preferably at least 10 mol/mol, most preferably at least 20 mol/mol. It has been found that, in this way, a favourable compromise between the desired high conversions and the reactor volume required is achieved.

In a particular configuration of the plant according to the invention for preparation of fatty acids by hydrolysis of fatty acid methyl esters (FAME), said plant comprises a second separation apparatus suitable for separating the heavy phase into a methanol-enriched third separation product and a water-enriched fourth separation product, means of feeding the heavy phase into the second separation apparatus, means of discharging the third separation product from the second separation apparatus and of discharging it from the plant as methanol product, means of discharging the fourth separation product from the second separation apparatus, means of recycling at least a portion of the fourth separation product to the at least one hydrolysis reactor. In this way, the use of fresh water as reactant is reduced and—optionally after further workup—a marketable methanol product is obtained as by-product.

Preferably, the plant according to the invention for preparation of fatty acids by hydrolysis of fatty acid methyl esters (FAME) further comprises means of feeding the hydrolysis product obtained in the at least one hydrolysis reactor to the second separation apparatus, means of selectively separating a methanol-enriched top product from the hydrolysis product, means of discharging the methanol-enriched top product from the plant as methanol product. In this way too—optionally after further workup—a marketable methanol product is obtained as by-product. Moreover, the amount or flow rate of the hydrolysis product is reduced, and so the downstream phase separation apparatus can be made smaller. If the hydrolysis product that has been freed of a portion of the methanol is to be cooled prior to introduction into the phase separation apparatus, in order to promote the phase separation, the reduction in volume additionally results in a reduction in the amount of cooling energy required.

With regard to the last-discussed configuration of the plant according to the invention, it is particularly preferred when the second separation apparatus is configured as a flash stage, preferably as an adiabatic flash stage. As a result, there is already preliminary cooling of the hydrolysis product that has been freed of a portion of the methanol prior to introduction into the phase separation apparatus, such that the amount of cooling energy required is reduced. In particularly favourable cases in which the adiabatic expansion already brings about sufficient cooling action, it is possible as a result for a cooling apparatus upstream of the phase separation apparatus to be dispensed with completely. However, it is generally preferable that a cooling apparatus upstream of the phase separation apparatus is also present, since this gives rise to greater degrees of freedom with regard to the adjustment of the temperature in the phase separation apparatus.

In a further aspect of the plant according to the invention for preparation of fatty acids by hydrolysis of fatty acid methyl esters (FAME), said plant further comprises means of feeding the methanol-depleted hydrolysis product to the phase separation apparatus, means of recycling at least a portion of the heavy phase to the at least one hydrolysis reactor, means of feeding the light phase to the first separation apparatus. The removal of a portion of the methanol from the hydrolysis product improves and facilitates the phase separation in the phase separation apparatus, since methanol acts as solubilizer between the light organic/nonpolar phase and the heavy aqueous/polar phase.

Preferably, the plant according to the invention further comprises a cooling apparatus upstream of the phase separation apparatus. This can be used advantageously when the cooling action of the adiabatic expansion stage for partial separation of methanol on its own is insufficient for achieving good and rapid phase separation in the phase separation apparatus.

BRIEF DESCRIPTION OF THE DRAWINGS

Developments, advantages and possible uses of the invention will also be apparent from the description of working and numerical examples and of the drawings which follows. In this context, all features that have been described and/or represented in images, in themselves or in any combination, form the invention, irrespective of their recapitulation in the claims or the dependency references thereof.

The figures show.

DETAILED DESCRIPTION OF THE INVENTION

Figure 1:
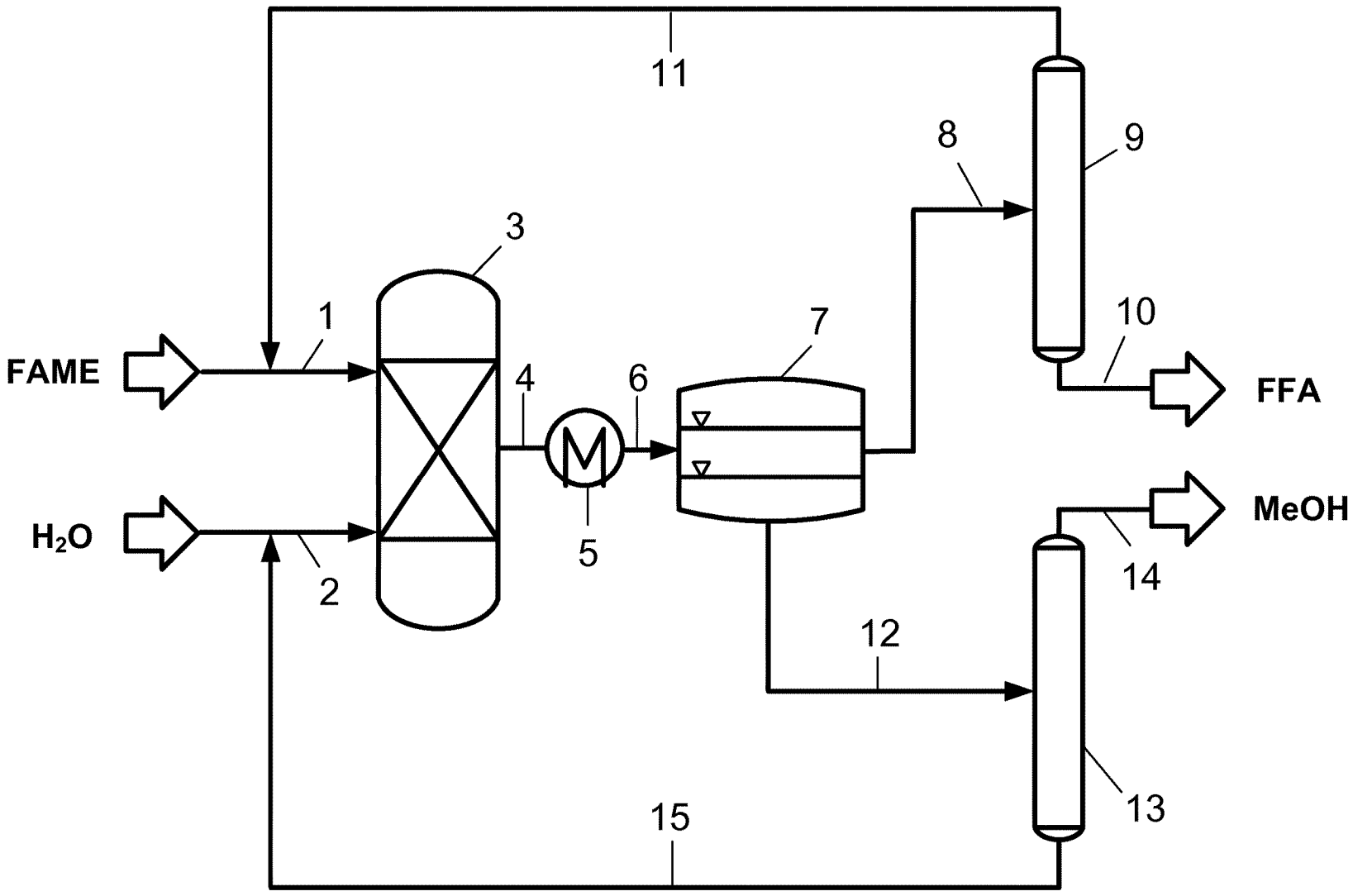
FIG. 1 the schematic representation of the process according to the invention or of the plant according to the invention in a first configuration, FIG. 2 the schematic representation of the process according to the invention or of the plant according to the invention in a second configuration.

In the schematic flow diagram, shown in FIG. 1, of a first configuration of the process according to the invention or of the plant according to the invention, the fatty acid methyl ester (FAME) and water ($H_2O$) are fed to the hydrolysis reactor 3 via conduits 1 and 2. The hydrolysis reactor, indicated merely in schematic form, works continuously with vigorous backmixing and is configured, for example, as a continuous stirred tank reactor. A portion of the water required for the ester hydrolysis can also be introduced into the hydrolysis reactor as steam. Preferably, this is done in such a way as to additionally contribute to the mixing of the liquid reaction mixture, i.e., for example, by blowing it into the liquid mixture. It may also be the case that the steam serves as heat carrier for heating of the contents of the reactor.

The reactor pressure is chosen such that the reaction mixture remains in the liquid phase at the reaction temperature established by a heating apparatus which is not shown in the diagram. The pressure is adjusted in a known manner via the vapour pressure of the components involved and optionally additionally by addition of an inert gas.

On attainment of a particular final conversion, the hydrolysis product leaves the hydrolysis reactor via conduit 4, is cooled in the cooling apparatus 5 and is then fed to the phase separation apparatus 7 via conduit 6. The phase separation apparatus in the example shown is a simple vessel with overflows and outlets for a heavy liquid phase and a light liquid phase, in which the phases are separated under gravity owing to the different density of the two liquid phases.

From the phase separation apparatus, the light nonpolar phase comprising the free fatty acid product (FFA) and unconverted fatty acid methyl ester is removed via conduit 8 and introduced into the first separation apparatus which, in the example shown, is configured as a distillation. In the distillative separation of the light phase, a fraction enriched in free fatty acids is obtained (first separation product), which is discharged from the process as FFA product via conduit 10. The remaining fraction (second separation product) which is recycled via conduits 11 and 1 to the hydrolysis reactor 3 comprises, as well as unconverted fatty acid methyl ester, also traces of methanol and significant proportions of free fatty acid. The latter, after being recycled into the hydrolysis reactor, acts as catalyst for the conversion of further fatty acid methyl ester to free fatty acid.

The heavy polar phase comprising unconverted water and methanol as co-product of the ester hydrolysis is removed from the phase separation apparatus 7 via conduit 12 and introduced into the second separation apparatus 13 which, in the example shown, is likewise configured as a distillation. In the distillative separation of the heavy phase, the top product obtained from distillation is a methanol product (MeOH) (third separation product), which is discharged from the process via conduit 14 and optionally sent to further workup. The bottom product obtained is a water-enriched fraction (fourth separation product), which is recycled via conduits 15 and 2 to the hydrolysis reactor 3.

Figure 2:
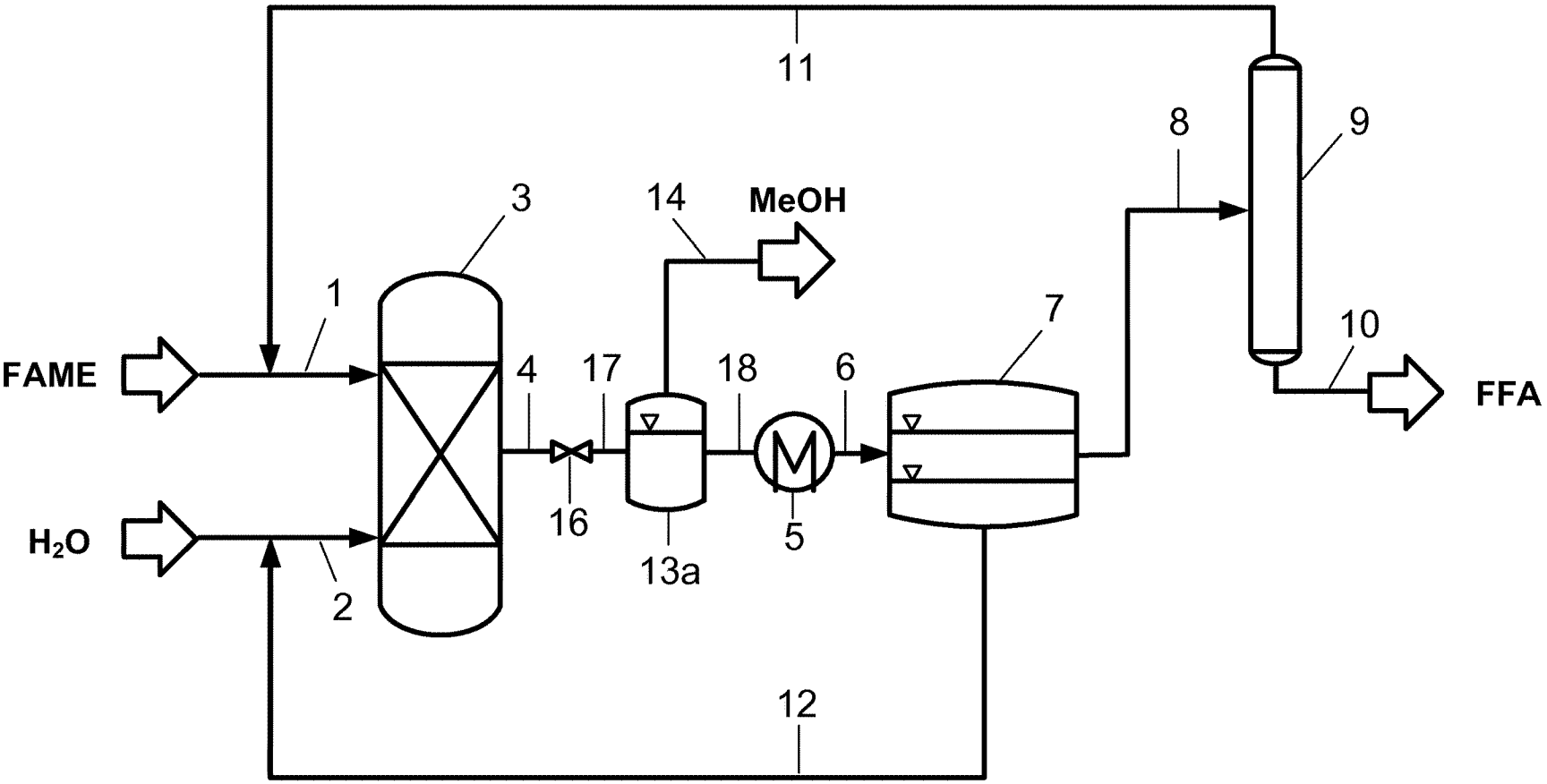

In the schematic diagram of a second configuration of the process according to the invention or of the plant according to the invention shown in FIG. 2, the process procedure as far as reference numeral 3 corresponds to that in FIG. 1. On attainment of a particular final conversion, the hydrolysis product leaves the hydrolysis reactor via conduit 4, but is then subjected to adiabatic (flash) expansion by means of expansion valve 16 and introduced via conduit 17 into the second separation apparatus 13*a*, which is configured here as a simple phase separation apparatus for separation of a gaseous, methanol-enriched phase (third separation product) from a methanol-depleted liquid phase (fourth separation product). The top product obtained from the phase separation apparatus 13*a* is a methanol product (MeOH) (third separation product), which is discharged from the process via conduit 14 and optionally sent to further workup.

On account of the adiabatic expansion, the temperature of the fourth separation product is lower than that of the hydrolysis product leaving the hydrolysis reactor 3. As a result, the cooling apparatus 5 to which the methanol-depleted liquid phase is applied via conduit 18 can be designed in a smaller size in terms of the cooling output required to establish a defined temperature in the phase separation apparatus 7.

Via conduit 6, the methanol-depleted liquid phase is applied to the phase separation apparatus 7, the properties and mode of operation of which correspond substantially to those that have been elucidated in FIG. 1. However, the phase separation proceeds more easily or quickly compared to the configuration shown in FIG. 1, since methanol, which acts as a solubilizer between the polar and nonpolar phase and hence makes the phase separation more difficult, has been removed from the liquid phase beforehand. Because of the more rapid phase separation, the phase separation apparatus 7 in the configuration shown in FIG. 2 can thus have a smaller design.

In the distillative separation in the first separation apparatus 9 to which the light phase is applied via conduit 8, a fraction enriched in free fatty acids is obtained (first separation product), which is discharged from the process as FFA product via conduit 10. The remaining fraction (second separation product) which is recycled to the hydrolysis reactor 3 via conduits 11 and 1 comprises, as well as unconverted fatty acid methyl ester, also traces of methanol and significant proportions of free fatty acid. The latter, after being recycled into the hydrolysis reactor, acts as catalyst for the conversion of further fatty acid methyl ester to free fatty acid.

The heavy polar phase discharged from the phase separation apparatus 7 via conduit 12, comprising unconverted water and methanol as co-product of the ester hydrolysis, is recycled via conduit 12 and conduit 2 to the hydrolysis reactor 3.

Of all the recycle streams in the working examples shown in FIG. 1 and FIG. 2, small proportions can be discharged and discarded (purged), in order to prevent the accumulation of impurities and other unwanted components.

In both working examples discussed, it is possible to discharge a methanol-rich stream as top product from the reaction apparatus via a conduit which is not shown. In this way, the reaction equilibrium is shifted in the direction of the hydrolysis products and hence the hydrolysis reaction is promoted.

NUMERICAL EXAMPLES

Reaction Parameters

To demonstrate the hydrolysis reaction, experiments were conducted in an autoclave with various experimental parameters and FAME chain lengths. The reaction mixture was stirred here at a stirrer rotation speed of 500 $min^{-1}$. The experimental results obtained are compiled in Table 1.

Within experiment series 1, a distinct acceleration of the conversion profile with increasing temperature becomes apparent. At 240 and 260° C. an identical final state is achieved, whereas at 220° C. the observation time was insufficient to attain this state.

The effect of methanol discharge by means of flash evaporation during the reaction is shown by the comparison between Examples 1c and 2a. The conversion achieved is about 5% higher in the final state of the reaction mixture if methanol has been removed from equilibrium.

TABLE 1

FAME conversion as a function of reaction time, temperature and water/FAME ratio

| | Experiment No. | | | | | | | | | | |
|---|---|---|---|---|---|---|---|---|---|---|---|
| | 1a | 1b | 1c | 2a | 2b | 2c | 3a | 3b | 3c | 4a | 4b |
| FAME chain length | C8 | C8 | C8 | C8 | C8 | C8 | C8 | C8 | C8 | C10 | C10 |
| Water/FAME* | 16 | 16 | 16 | 16 | 8 | 2 | 24 | 16 | 8 | 16 | 8 |
| T/° C. | 220 | 240 | 260 | 260 | 260 | 260 | 240 | 240 | 240 | 260 | 260 |
| MeOH discharge** | yes | yes | yes | no | no | no | no | no | no | no | no |

TABLE 1-continued

FAME conversion as a function of reaction time, temperature and water/FAME ratio

| | Experiment No. | | | | | | | | | | |
|---|---|---|---|---|---|---|---|---|---|---|---|
| | 1a | 1b | 1c | 2a | 2b | 2c | 3a | 3b | 3c | 4a | 4b |
| Reaction time/h | FAME conversion | | | | | | | | | | |
| 0.5 h | 2% | 5% | 24% | 21% | 12% | 5% | 7% | 10% | 3% | 12% | 10% |
| 1.0 h | 7% | 23% | 60% | 63% | 43% | 32% | 26% | 33% | 13% | 44% | 41% |
| 1.5 h | 19% | 61% | 74% | 73% | 61% | 44% | 52% | 58% | 37% | 68% | 58% |
| 2.0 h | 35% | 76% | 78% | 75% | 63% | 45% | 72% | 72% | 52% | 71% | 62% |
| 3.0 h | 58% | 80% | 80% | 75% | 63% | 45% | 77% | 75% | 62% | 72% | 63% |
| 4.0 h | 67% | 80% | 80% | 75% | 63% | 45% | 79% | 75% | 62% | 72% | 63% |

*water/FAME ratio [mol of water per mole of FAME]

**methanol was evaporated (flashed) out of the reaction mixture by lowering the pressure during the reaction The effect of the water/FAME ratio is shown by experiment series 2 and 3. The magnitude of the conversion attained in the final state increases with an increased amount of water. In the case of identical water/FAME ratios, an increase in temperature brings about a shortening of the reaction time needed to attain this final state.

The effect of the FAME chain length becomes clear in the comparison of experiments 2a and 2b with experiments 4a and 4b. In this case, under otherwise identical conditions, conversions at a comparable level are attained after an identical reaction time.

The experiments were repeated with different stirrer rotation speeds. Within the first two hours of the experiment, faster rises in the conversion curve against time were found at higher stirrer rotation speeds. After 2 h in each experiment, however, an identical final state of the conversion was attained.

Catalytic Effect of Free Fatty Acids (FFA)

To demonstrate the catalytic effect of free fatty acids on the hydrolysis reaction, further experiments were conducted in an autoclave at different temperatures under otherwise identical conditions both with and without addition of FFA. The amount of the FFA added was 5.28% g/g, based on the amount of $C_{10}$-FAME used, which corresponded to an FFA concentration of 5% by weight in FAME, or about 3% by weight, based on the overall reaction mixture. The reaction mixture was stirred here at 500 $min^{-1}$. The results obtained here are compiled in Table 2 below.

Experiment series 6 served as reference, since addition of FFA was dispensed with here. Within experiment series 6, a distinct retardation in the conversion profile became apparent with decreasing temperature. In contrast to the results with $C_8$-FAME (cf. Table 1, experiment series 1a to 1b), an identical final state was not attained at the varying temperature of 240 to 260° C.

In the comparison with experiment series 7 (with addition of FFA), the catalytic effect of the free fatty acid at the start of the reaction becomes clear. Here, a constant final state was attained after only 2 h, whereas this was not attained in experiment series 6 until after 3 h (experiment 6b+6c).

The magnitude of the FAME conversion in the final state in the experiments with addition of FFA decreases proportionally with the concentration of the FFA added in the FAME, since the FFA concentration in the final state of the reaction is established in an equilibrium and hence leads to a restriction of the maximum FAME conversion.

TABLE 2

FAME conversion as a function of the reaction time and temperature with and without FFA as catalyst

| | Experiment No. | | | | | |
|---|---|---|---|---|---|---|
| | 6a | 6b | 6c | 7a | 7b | 7c |
| FAME chain length | C10 | C10 | C10 | C10 | C10 | C10 |
| Water/FAME* | 9.5 | 9.5 | 9.5 | 9.5 | 9.5 | 9.5 |
| T/° C. | 260 | 250 | 240 | 260 | 250 | 240 |
| MeOH discharge** | no | no | no | no | no | no |
| FFA addition | no | no | no | yes | yes | yes |
| Reaction time/h | FAME conversion | | | | | |
| 0.5 h | 7% | 4% | 1% | 45.1% | 30% | 23% |
| 1.0 h | 41% | 23% | 8% | 62.0% | 53% | 46% |
| 1.5 h | 64% | 52% | 27% | 64.1% | 58% | 54% |
| 2.0 h | 68% | 61% | 48% | 64.4% | 60% | 57% |
| 3.0 h | 68% | 64% | 60% | 64.4% | 60% | 57% |
| 4.0 h | 68% | 64% | 60% | 64.4% | 60% | 57% |

*water/FAME ratio [mol of water per mole of FAME]

**methanol was evaporated (flashed) out of the reaction mixture by lowering the pressure during the reaction Phase Separation of the Reaction Mixture in the Final State from Experimental Example 2a The reaction mixture from experimental example 2a (see Table 1) with a water/FAME ratio of 16 mol/mol was produced in an autoclave equipped with a sightglass. Thus, the observation of phase volumes and the controlled sampling of the individual phases was enabled. As a result of the good solubility ratios of the relatively short-chain reactants and products in one another (in this case $C_8$-FAME as reactant), a homogeneous reaction mixture formed in the final state of the reaction. In the course of cooling of this homogeneous reaction mixture, commencement of phase formation was observed from 224° C. (cloud point). The cooling was continued gradually and the phases that formed were each determined volumetrically and analysed (see Table 3).

TABLE 3

| Phase formation and phase composition; reaction mixture from experimental example 2a | | | | |
|---|---|---|---|---|
| | | Ex. No. | | |
| | | 2a/1 | 2a/2 | 2a/3 |
| Upper phase component | | 50% vol FFA + FAME-rich light phase | 46% vol | 43% vol |
| | | % w/w | % w/w | % w/w |
| | Water | 33.8 | 26.2 | 18.6 |
| | Methanol | 4.3 | 4.3 | 3.8 |
| | FAME | 18.2 | 20.9 | 23.2 |
| | FFA | 43.7 | 48.6 | 54.4 |
| Reaction mixture in the final state of the hydrolysis reaction | | Cooling to 217° C. | Cooling to 199° C. | Cooling to 177° C. |
| % w/w | | | | |
| Water | 64.2 | | | |
| Methanol | 5.3 | | | |
| FAME | 8.3 | | | |
| FFA | 22.2 | | | |
| Lower phase component | | 50% vol Water- + methanol-rich heavy phase | 54% vol | 57% vol |
| | | % w/w | % w/w | % w/w |
| | Water | 89.1 | 92.1 | 93.2 |
| | Methanol | 5.9 | 5.7 | 5.9 |
| | FAME | 1.1 | 0.4 | 0.2 |
| | FFA | 3.9 | 1.8 | 0.7 |

Formation of an FFA- and FAME-rich light phase and of a water- and methanol-rich heavy phase was observed. With decreasing phase separation temperature (2a/1>2a/2>2a/3), the separation was completed such that there was further enrichment of FFA and FAME in the light phase and further enrichment of water and methanol in the heavy phase.

Phase Separation of the Reaction Mixture in the Final State from Experimental Example 2b The reaction mixture from experimental example 2b (for preparation see Table 1) with a water/FAME ratio of 8 mol/mol was produced in an autoclave equipped with a sightglass. Thus, the observation of phase volumes and the controlled sampling of the individual phases was enabled. As a result of the good solubility ratios of the relatively short-chain reactants and products in one another (in this case $C_8$-FAME as reactant), a homogeneous reaction mixture formed here too in the final state of the reaction. In the course of cooling of this homogeneous reaction mixture, commencement of phase formation was observed from 227° C. (cloud point). The cooling was continued gradually and the phases that formed were each determined volumetrically and analysed (see Table 4).

Again, the formation of an FFA- and FAME-rich light phase and of a water- and methanol-rich heavy phase was observed. Here too, the separation was completed with decreasing phase separation temperature (2b/1>2b/2>2b/3) in such a way that there was further enrichment of FFA and FAME in the light phase and further enrichment of water and methanol in the heavy phase. An exception here is the water- and methanol-rich heavy phase in Example 2b/3. In the course of cooling to 180° C., cloudiness (an emulsion) was observed, which explains the deviation in its composition.

TABLE 4

| Phase formation and the phase composition thereof; reaction mixture from experimental example 2b | | | | |
|---|---|---|---|---|
| | | Ex. No. | | |
| | | 2b/1 | 2b/2 | 2b/3 |
| Upper phase component | | not determined FFA + FAME-rich light phase | 52% vol | 61% vol |
| | | % w/w | % w/w | % w/w |
| | Water | 30.5 | 22.6 | 17.5 |
| | Methanol | 6.3 | 5.7 | 5.4 |
| | FAME | 28.8 | 29.3 | 33.5 |
| | FFA | 34.3 | 42.5 | 43.5 |
| Reaction mixture in the final state of the hydrolysis reaction | | Cooling to 215° C. | Cooling to 197° C. | Cooling to 180° C. |
| % w/w | | | | |
| Water | 43.1 | | | |
| Methanol | 6.8 | | | |
| FAME | 19.9 | | | |
| FFA | 30.1 | | | |
| Lower phase component | | not determined Water- + methanol-rich heavy phase | 48% vol | 39% vol |
| | | % w/w | % w/w | % w/w |
| | Water | 86.9 | 89.5 | 84.6 |
| | Methanol | 8.1 | 8.1 | 8.3 |
| | FAME | 1.8 | 0.7 | 3.7 |
| | FFA | 3.2 | 1.7 | 3.4 |

Industrial applicability

The invention provides a process and a plant with which free fatty acids can be obtained in a simple manner by hydrolysis of fatty acid alkyl esters, especially fatty acid methyl esters (FAME), or alternatively of fatty acid triglycerides present in oils and fats of vegetable and animal origin. Since the process does not require the use of external substances extraneous to the process as homogeneous or heterogeneous catalysts, particular economic and ecological advantages are obtained, since there is no need for any catalysts to be recovered from the hydrolysis product and subsequently regenerated or disposed of in a costly and inconvenient manner. The autocatalytic action of the free fatty acids added to the reaction mixture permits a reduction in size of the reaction apparatuses used for achievement of a fixed production rate.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

LIST OF REFERENCE NUMERALS

[1] conduit
[2] conduit
[3] hydrolysis reactor
[4] conduit
[5] cooling apparatus
[6] conduit
[7] phase separation apparatus
[8] conduit
[9] first separation apparatus (distillation)
[10] conduit
[11] conduit
[12] conduit
[13] second separation apparatus (distillation)
[13*a*] second separation apparatus (phase separation apparatus, flash)
[14] conduit
[15] conduit
[16] expansion valve
[17] conduit
[18] conduit

The invention claimed is:

1. A process for preparing fatty acids by hydrolysis of fatty acid alkyl esters, the process comprising the following steps:

a) providing the fatty acid alkyl esters;

b) reacting the fatty acid alkyl esters with water under hydrolysis conditions at temperatures of at least 200° C., where the pressure is chosen such that the water is in the liquid phase and where no external substance extraneous to the process is added as homogeneous or heterogeneous catalyst;

c) discharging a hydrolysis product comprising free fatty acids (FFA), water, unconverted fatty acid alkyl esters and methanol;

d) feeding the hydrolysis product to a phase separation apparatus and separating the hydrolysis product under phase separation conditions into a light phase comprising free fatty acids and unconverted fatty acid alkyl esters and a heavy phase comprising water and methanol;

e) feeding the light phase into a first separation apparatus that works by a thermal separation process and separating the light phase into a first separation product enriched in free fatty acids and a second separation product enriched in unconverted fatty acid alkyl esters, the separation being conducted in such a way that the second separation product further comprises a proportion of free fatty acids;

f) discharging the first separation product as FFA product; and g) recycling at least a portion of the second separation product to reaction step b).

2. The process according to claim 1, wherein feeding step e) and/or recycling step g) are effected in such a way that, during reaction step b), the proportion of free fatty acids, based on the proportion of fatty acid alkyl ester, is >0% to 10% by weight.

3. The process according to claim 1, wherein reaction step b) is conducted at a temperature of at least 220° C.

4. The process according to claim 1, wherein the methanol-comprising heavy phase obtained in step d) is fed to a second separation apparatus that works by a thermal separation process and separated into a methanol-enriched third separation product and a water-enriched fourth separation product, the third separation product being discharged from the process as methanol product and the fourth separation product being at least partly recycled to reaction step b).

5. The process according to claim 1, wherein the hydrolysis product obtained in step b) is first fed to the second separation apparatus in which a methanol-enriched top product is selectively separated from the hydrolysis product and discharged from the process as methanol product.

6. The process according to claim 5, wherein the second separation apparatus is configured as a flash stage which is preferably configured and operated in an adiabatic manner.

7. The process according to claim 5, wherein the methanol-depleted hydrolysis product is fed to the phase separation apparatus and separated therein under phase separation conditions into a light phase comprising free fatty acids and unconverted fatty acid alkyl esters and a heavy phase comprising water and methanol, the heavy phase being at least partly recycled to reaction step b) and the light phase being fed to the first separation apparatus.

8. The process according to claim 1, wherein the phase separation conditions comprise the cooling of the hydrolysis product or of the methanol-depleted hydrolysis product to a temperature of ≤220° C.

9. The process according to claim 8, wherein the cooling is brought about by means of a cooling apparatus upstream of the phase separation apparatus and/or by virtue of the separation of the methanol-enriched top product from the hydrolysis product being conducted adiabatically.

10. The process according to claim 1, wherein the phase separation conditions comprise the cooling of the hydrolysis product or of the methanol-depleted hydrolysis product to a temperature of ≤180° C.

11. The process according to claim 1, wherein the ratio of water to fatty acid methyl ester in the reaction of fatty acid methyl ester with water in step b) is at least 2 mol/mol.

12. A plant for preparation of fatty acids by hydrolysis of fatty acid alkyl esters, comprising the following plant components:

a) means of providing the fatty acid alkyl esters;

b) at least one hydrolysis reactor for reacting the fatty acid alkyl esters with water under hydrolysis conditions at temperatures of at least 200° C., suitable for establishing a pressure at which the water is in the liquid phase at the reaction temperature;

c) means of discharging a hydrolysis product comprising free fatty acids (FFA), water, unconverted fatty acid alkyl esters and methanol;

d) a phase separation apparatus suitable for separating the hydrolysis product under phase separation conditions into a light phase comprising free fatty acids and unconverted fatty acid alkyl esters and a heavy phase comprising water and methanol, means of feeding the hydrolysis product to the phase separation apparatus, means of discharging the light phase, means of discharging the heavy phase;

e) a first separation apparatus which works by a thermal separation process, suitable for separating the light phase into a first separation product enriched in free fatty acids and a second separation product enriched in unconverted fatty acid alkyl esters, the second separation product further comprising a proportion of free fatty acids, means of feeding the light phase into the first separation apparatus, means of discharging a first separation product from the first separation apparatus, means of discharging a second separation product from the first separation apparatus;

f) means of discharging the first separation product as FFA product; and g) means of recycling at least a portion of the second separation product to the at least one hydrolysis reactor.

13. The plant according to claim 12, further comprising a second separation apparatus suitable for separating the heavy phase into a methanol-enriched third separation product and a water-enriched fourth separation product, means of feeding the heavy phase into the second separation apparatus, means of discharging the third separation product from the second separation apparatus and of discharging it from the plant as methanol product, means of discharging the fourth separation product from the second separation apparatus, means of recycling at least a portion of the fourth separation product to the at least one hydrolysis reactor.

14. The plant according to claim 13, further comprising means of feeding the hydrolysis product obtained in the at least one hydrolysis reactor to the second separation apparatus, means of selectively separating a methanol-enriched top product from the hydrolysis product, means of discharging the methanol-enriched top product from the plant as methanol product.

15. The plant according to claim 14, wherein the second separation apparatus is configured as a flash stage, preferably as an adiabatic flash stage.

16. The plant according to claim 14, further comprising means of feeding the methanol-depleted hydrolysis product to the phase separation apparatus, means of recycling at least a portion of the heavy phase to the at least one hydrolysis reactor, means of feeding the light phase to the first separation apparatus.

17. The process according to claim 1, wherein the fatty acid alkyl esters comprise fatty acid methyl esters (FAME).

18. The plant according to claim 13, wherein the fatty acid alkyl esters comprise fatty acid methyl esters (FAME).

* * * * *